US006273968B1

(12) United States Patent
Thomas

(10) Patent No.: US 6,273,968 B1
(45) Date of Patent: Aug. 14, 2001

(54) LOW-CARBON STEELS OF SUPERIOR MECHANICAL AND CORROSION PROPERTIES AND PROCESS OF MAKING THEREOF

(75) Inventor: Gareth Thomas, Sonoma, CA (US)

(73) Assignee: MMFX Steel Corporation of America, Newport Beach, CA (US)

( * ) Notice: Subject to any disclaimer, the term of this patent is extended or adjusted under 35 U.S.C. 154(b) by 0 days.

(21) Appl. No.: 09/537,000

(22) Filed: Mar. 28, 2000

Related U.S. Application Data

(60) Provisional application No. 60/143,321, filed on Jul. 12, 1999.

(51) Int. Cl.[7] ..... C22C 38/18; C21D 9/00

(52) U.S. Cl. ..... 148/333; 148/320; 148/325; 148/660; 148/661

(58) Field of Search ..... 148/333, 325, 148/660, 661, 320

(56) References Cited

U.S. PATENT DOCUMENTS

| | | |
|---|---|---|
| 2,395,608 | 2/1946 | Aborn . |
| 2,778,079 | 1/1957 | Carney et al. . |
| 4,086,107 | 4/1978 | Tanino et al. . |
| 4,170,497 | 10/1979 | Thomas et al. . |
| 4,170,499 | 10/1979 | Thomas et al. . |
| 4,263,063 | 4/1981 | Hull et al. . |
| 4,613,385 | 9/1986 | Thomas et al. . |
| 4,619,714 | 10/1986 | Thomas et al. . |
| 4,671,827 | 6/1987 | Thomas et al. . |
| 5,129,966 | 7/1992 | Rao . |
| 5,492,573 | 2/1996 | Fukushima et al. . |
| 5,798,082 | 8/1998 | Kadoya et al. . |
| 5,980,662 | 11/1999 | Kim et al. . |
| 6,030,469 | 2/2000 | Ernst et al. . |

OTHER PUBLICATIONS

Chartock, "New Steel for a New Millennium," *Colorado Construction* (Dec. 1989) 38–39.

*Primary Examiner*—Deborah Yee
(74) *Attorney, Agent, or Firm*—Townsend and Townsend and Crew LLp

(57) ABSTRACT

Alloy steels that combine high strength and toughness with high corrosion resistance are achieved by a dislocated lath microstructure, in which dislocated martensite laths that are substantially free of twinning alternate with thin films of retained austenite, with an absence of autotempered carbides, nitrides and carbonitrides in both the dislocated martensite laths and the retained austenite films. This microstructure is achieved by selecting an alloy composition whose martensite start temperature is 350° C. or greater, and by selecting a cooling regime from the austenite phase through the martensite transition region that avoids regions in which autotempering occurs.

27 Claims, 3 Drawing Sheets

LOW-CARBON STEELS OF SUPERIOR MECHANICAL AND CORROSION PROPERTIES AND PROCESS OF MAKING THEREOF

CROSS-REFERENCE TO RELATED APPLICATION

This application is related to United States provisional application no. 60/143,321, filed on Jul. 12, 1999, entitled "Microcomposite Low Carbon Steels for Superior Mechanical and Corrosion Properties," naming Gareth Thomas as sole inventor. The contents of the provisional application are incorporated herein by reference in their entirety, and the benefit of the filing date of the provisional application is hereby claimed for all purposes that are legally served thereby.

BACKGROUND OF THE INVENTION

1. Field of the Invention

This invention resides in the field of steel alloys, particularly those of high strength, toughness, corrosion resistance, and cold formability, and also in the technology of the processing of steel alloys to form microstructures that provide the steel with particular physical and chemical properties.

2. Description of the Prior Art

Steel alloys of high strength and toughness and cold formability whose microstructures are composites of martensite and austenite phases are disclosed in the following United States patents (all assigned to The Regents of the University of California), each of which is incorporated herein by reference in its entirety:

- U.S. Pat. No. 4,170;497 (Gareth Thomas and Bangaru V. N. Rao), issued Oct. 9, 1979 on an application filed Aug. 24, 1977
- U.S. Pat. No. 4,170,499 (Gareth Thomas and Bangaru V. N. Rao), issued Oct. 9, 1979 on an application filed Sep. 14, 1978 as a continuation-in-part of the above application filed on Aug. 24, 1977
- U.S. Pat. No. 4,619,714 (Gareth Thomas, Jae-Hwan Ahn, and Nack-Joon Kim), issued Oct. 28, 1986 on an application filed Nov. 29, 1984, as a continuation-in-part of an application filed on Aug. 6, 1984
- U.S. Pat. No. 4,671,827 (Gareth Thomas, Nack J. Kim, and Ramamoorthy Ramesh), issued Jun. 9, 1987 on an application filed on Oct. 11, 1985

The microstructure plays a key role in establishing the properties of a particular steel alloy, and thus strength and toughness of the alloy depend not only on the selection and amounts of the alloying elements, but also on the crystalline phases present and their arrangement. Alloys intended for use in certain environments require higher strength and toughness, and in general a combination of properties that are often in conflict, since certain alloying elements that contribute to one property may detract from another.

The alloys disclosed in the patents listed above are carbon steel alloys that have microstructures consisting of laths of martensite alternating with thin films of austenite and dispersed with fine grains of carbides produced by autotempering. The arrangement in which laths of one phase are separated by thin films of the other is referred to as a "dislocated lath" structure, and is formed by first heating the alloy into the austenite range, then cooling the alloy below a phase transition temperature into a range in which austenite transforms to martensite, accompanied by rolling to achieve the desired shape of the product and to refine the alternating lath and thin film arrangement. This microstructure is preferable to the alternative of a twinned martensite structure, since the lath structure has a greater toughness. The patents also disclose that excess carbon in the lath regions precipitates during the cooling process to form cementite (iron carbide, $Fe_3C$) by a phenomenon known as "autotempering." These autotempered carbides are believed to contribute to the toughness of the steel.

The dislocated lath structure produces a high-strength steel that is both tough and ductile, qualities that are needed for resistance to crack propagation and for sufficient formability to permit the successful fabrication of engineering components from the steel. Controlling the martensite phase to achieve a dislocated lath structure rather than a twinned structure is one of the most effective means of achieving the necessary levels of strength and toughness, while the thin films of retained austenite contribute the qualities of ductility and formability. Achieving this dislocated lath microstructure rather than the less desirable twinned structure requires a careful selection of the alloy composition, since the alloy composition affects the martensite start temperature, commonly referred to as $M_s$, which is the temperature at which the martensite phase first begins to form. The martensite transition temperature is one of the factors that determine whether a twinned structure or a dislocated lath structure will be formed during the phase transition.

In many applications, the ability to resist corrosion is highly important to the success of the steel component. This is particularly true in steel-reinforced concrete in view of the porosity of concrete, and in steel that is used in moist environments in general. In view of the ever-present concerns about corrosion, there is a continuing effort to develop steel alloys with improved corrosion resistance. These and other matters in regard to the production of steel of high strength and toughness that is also resistant to corrosion are addressed by the present invention.

SUMMARY OF THE INVENTION

It has now been discovered that corrosion in a dislocated lath structure can be reduced by eliminating the presence of precipitates such as carbides, nitrides, and carbonitrides from the structure, including those that are produced by autotempering and also including transformation products such as bainite and pearlite containing carbides, nitrides or carbonitrides of different morphologies depending on composition, cooling rate, and other parameters of the alloying process. It has been discovered that the interfaces between the small crystals of these precipitates and the martensite phase through which the precipitates are dispersed promote corrosion by acting as galvanic cells, and that pitting of the steel begins at these interfaces. Accordingly, the present invention resides in part in an alloy steel with a dislocated lath microstructure that does not contain carbides, nitrides or carbonitrides, as well as a method for forming an alloy steel of this microstructure. The invention also resides in the discovery that this type of microstructure can be achieved by limiting the choice and the amounts of the alloying elements such that the martensite start temperature $M_s$ is 350° C. or greater. Still further, the invention resides in the discovery that while autotempering and other means of carbide, nitride or carbonitride precipitation in a dislocated lath structure can be avoided by a rapid cooling rate, certain alloy compositions will produce a dislocated lath structure free of autotempered products and precipitates in general simply by air cooling. These and other objects, features, and advantages of the invention will be better understood by the description that follows.

DESCRIPTION OF THE SPECIFIC EMBODIMENTS

Autotempering of an alloy composition occurs when a phase that is under stress due to supersaturation with an alloying element is relieved of its stress by precipitating the excess amount of the alloying element as a compound with another element of the alloy composition in such a manner that the resulting compound resides in isolated regions dispersed throughout the phase while the remainder of the phase reverts to a saturated condition. Autotempering will thus cause excess carbon to precipitate as iron carbide ($Fe_3C$). If chromium is present as an additional alloying element, some of the excess carbon may also precipitate as trichromium dicarbide ($Cr_3C_2$), and similar carbides may precipitate with other alloying elements. Autotempering will also cause excess nitrogen to precipitate as either nitrides or carbonitrides. All of these precipitates are collectively referred to herein as "autotempering (or autotempered) products" and it is the avoidance of these products and other transformation products that include precipitates that is achieved by the present invention as a means of accomplishing its goal of lessening the susceptibility of the alloy to corrosion.

The avoidance of the formation of autotempered products and carbides, nitrides and carbonitrides in general is achieved in accordance with this invention by appropriate selection of an alloy composition and a cooling rate through the martensite transition range. The phase transitions that occur upon cooling an alloy from the austenite phase are governed by the cooling rate at any particular stage of the cooling, and the transitions are commonly represented by phase transformation kinetic diagrams with temperature as the vertical axis and time as the horizontal axis, showing the different phases in different regions of the diagram, the lines between the regions representing the conditions at which transitions from one phase to another occur. The locations of the boundary lines in the phase diagram and thus the regions that are defined by the boundary lines vary with the alloy composition.

Figure 1:
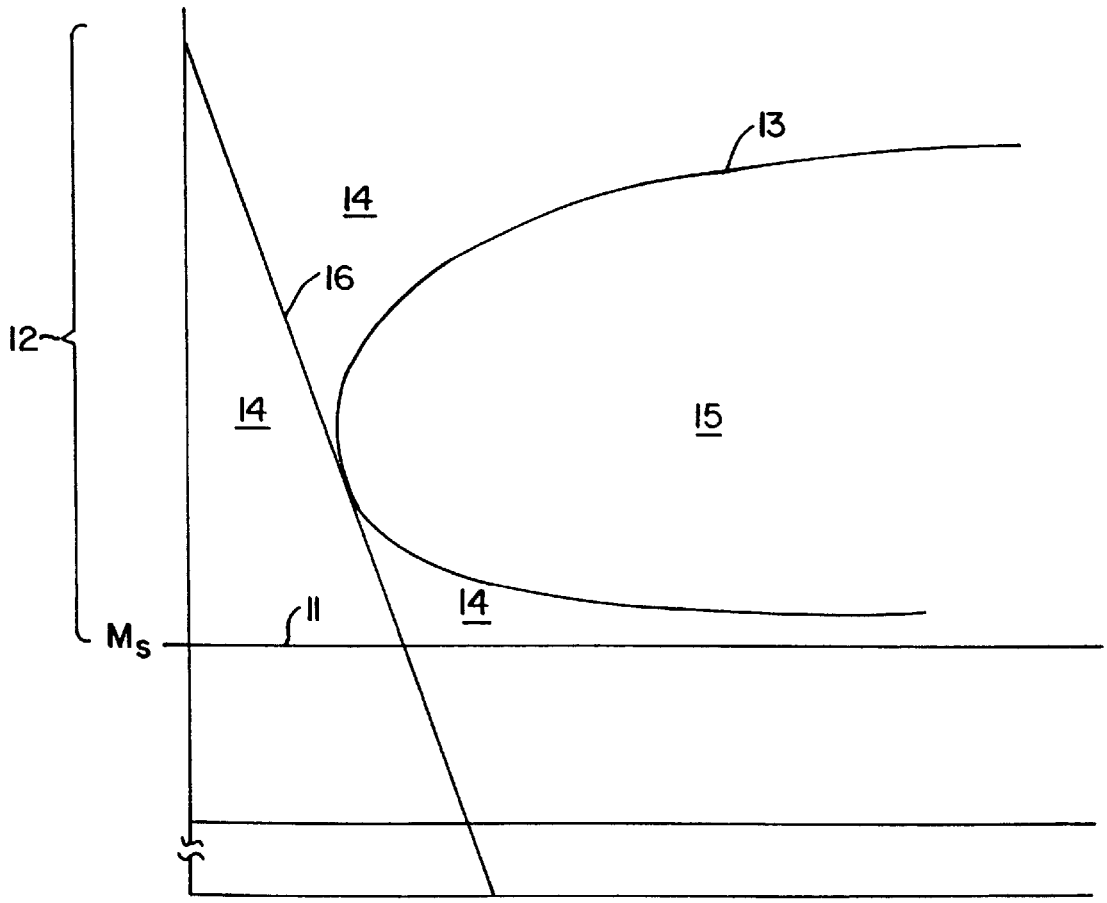
FIG. 1 is a phase transformation kinetic diagram demonstrating the alloy processing procedures and conditions of this invention.

An example of such a phase diagram is shown in FIG. 1. The martensite transition range is represented by the area below a horizontal line 11 which represents the martensite start temperature $M_s$ and the region 12 above this line is the region in which the austenite phase prevails. A C-shaped curve 13 within the region 12 above the $M_s$ line divides the austenite region into two subregions. The subregion 14 to the left of the "C" is that in which the alloy remains entirely in the austenite phase, while the subregion 15 to the right of the "C" is that in which autotempered products and other transformation products that contain carbides, nitrides or carbonitrides of various morphologies, such as bainite and pearlite, form within the austenite phase. The position of the $M_s$ line and the position and curvature of the "C" curve will vary with the choice of alloying elements and the amounts of each.

The avoidance of the formation of autotempering products is thus achieved by selecting a cooling regime which avoids intersection with or passage through the autotempered products subregion 15 (inside the curve of the "C"). If for example a constant cooling rate is used, the cooling regime will be represented by a straight line that is well into the austenite regime 14 at time zero and has a constant (negative) slope. The upper limit of cooling rates that will avoid the autotempered products subregion 15 is represented by the line 16 in the Figure which is tangential to the "C" curve. To avoid the formation of autotempered products or carbides in general, a cooling rate must be used that is represented by a line to the left of the limit line 16 (i.e., one starting at the same time-zero point but having a steeper slope).

Depending on the alloy composition, therefore, a cooling rate that is sufficiently great to meet this requirement may be one that requires water cooling or one that can be achieved with air cooling. In general, if the levels of certain alloying elements in an alloy composition that is air-coolable and still has a sufficiently high cooling rate are lowered, it will be necessary to raise the levels of other alloying elements to retain the ability to use air cooling. For example, the lowering of one or more of such alloying elements as carbon, chromium, or silicon may be compensated for by raising the level of an element such as manganese.

Alloy compositions for example that contain (i) from about 0.05% to about 0.1% carbon, (ii) either silicon or chomium at a concentration of at least about 2%, and (iii) manganese at a concentration of at least about 0.5%, all by weight (the remainder being iron), are preferably cooled by a water quench. Specific examples of these alloy compositions are (A) an alloy in which the alloying elements are 2% silicon, 0.5% manganese, and 0.1% carbon, and (B) an alloy in which the alloying elements are 2% chromium, 0.5% manganese, and 0.05% carbon (all by weight with iron as the remainder). Examples of alloy compositions that can be cooled by air cooling while still avoiding the formation of autotempered products are those that contain as alloying elements about 0.03% to about 0.05% carbon, about 8% to about 12% chromium, and about 0.2% to about 0.5% manganese, all by weight (the remainder being iron). Specific examples of these alloy compositions are (A) those containing 0.05% carbon, 8% chromium, and 0.5% manganese, and (B) those containing 0.03% carbon, 12% chromium, and 0.2% manganese. It is emphasized that these are only examples. Other alloying compositions will be apparent to those skilled in the art of steel alloys and those familiar with steel phase transformation kinetic diagrams.

As stated above, the avoidance of twinning during the phase transition is achieved by using an alloy composition that has a martensite start temperature Ms of about 350° C. or greater. A preferred means of achieving this result is by use of an alloy composition that contains carbon as an alloying element at a concentration of from about 0.01% to about 0.35%, more preferably from about 0.05% to about 0.20%, or from about 0.02% to about 0.15%, all by weight. Examples of other alloying elements that may also be included are chromium, silicon, manganese, nickel, molybdenum, cobalt, aluminum, and nitrogen, either singly or in combinations. Chromium is particularly preferred for its passivating capability as a further means of imparting corrosion resistance to the steel. When chromium is included, its content may vary, but in most cases chromium will constitute an amount within the range of about 1% to about 13% by weight. A preferred range for the chromium content is about 6% to about 12% by weight, and a more preferred range is about 8% to about 10% by weight. When silicon is present, its concentration may vary as well. Silicon is preferably present at a maximum of about 2% by weight, and most preferably from about 0.5% to about 2.0% by weight.

The processing procedures and conditions set forth in the four Thomas et al. U.S. patents referenced above including existing bar and rod mill practice may be used in the practice of the present invention for the heating of the alloy composition to the austenite phase, the cooling of the alloy from the austenite phase through the martensite transition region, and the rolling of the alloy at one or more stages of the process. In accordance with these procedures, the heating of the alloy composition to the austenite phase is preferably performed at a temperature up to about 1150° C., or more preferably within the range of from about 900° C. to about 1150° C. The alloy is then held at this austenitization temperature for a sufficient period of time to achieve substantially full orientation of the elements according to the crystal structure of the austenite phase. Rolling is performed in a controlled manner at one or more stages during the austenitization and cooling procedures to deform the crystal grains and store strain energy into the grains, and to guide the newly forming martensite phase into a dislocated lath arrangement of martensite laths separated by thin films of retained austenite. Rolling at the austenitization temperature aids in the diffusion of the alloying elements to form a homogeneous austenite crystalline phase. This is generally achieved by rolling to reductions of 10% or greater, and preferably to reductions ranging from about 30% to about 60%.

Figure 2:
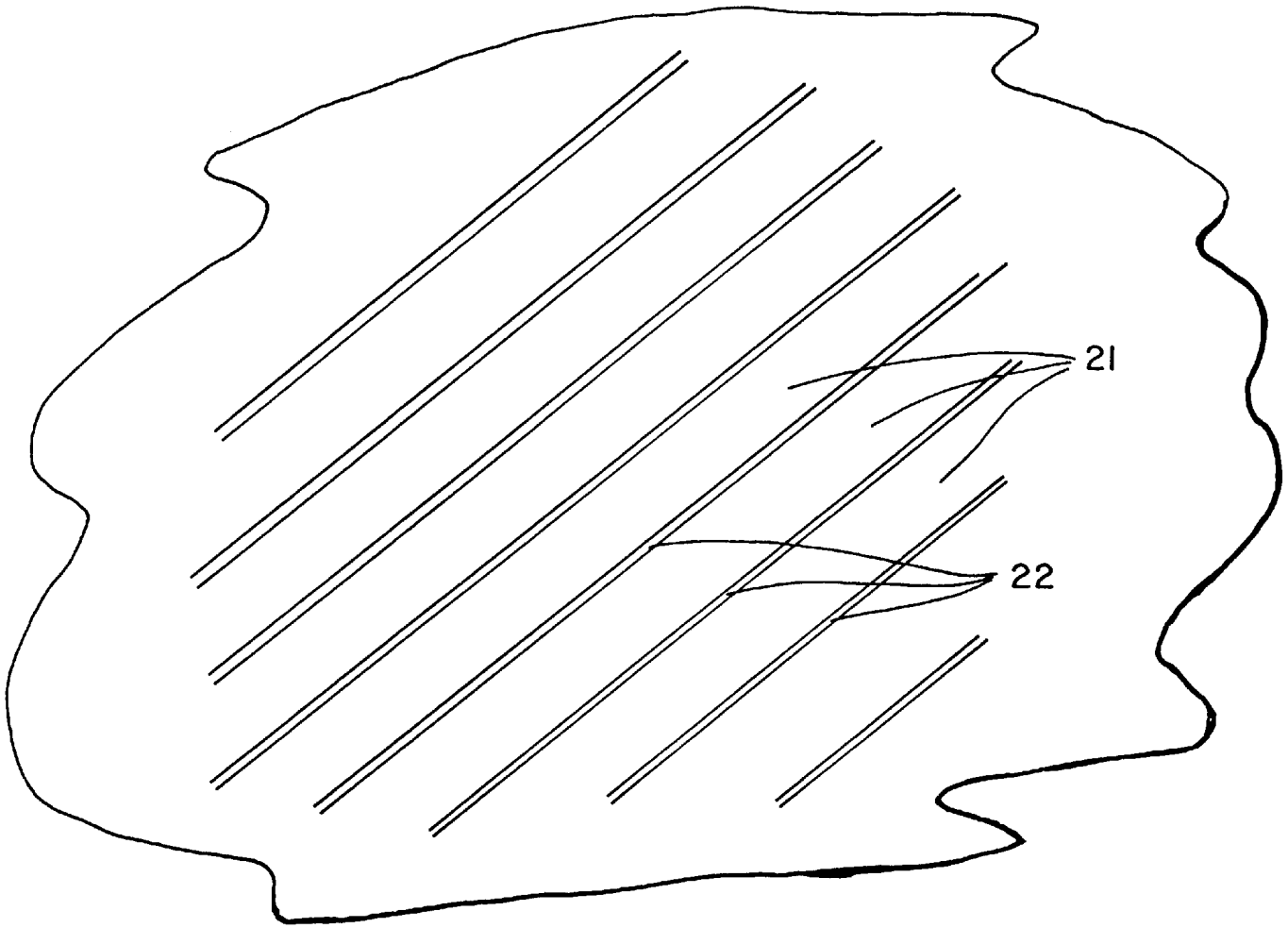
FIG. 2 is a sketch representing the microstructure of the alloy composition of this invention.

Partial cooling followed by further rolling may then take place, guiding the grains and crystal structure toward the dislocated lath arrangement, followed by final cooling in a manner that will achieve a cooling rate that avoids regions in which autotempered or transformation products will be formed, as described above. The thicknesses of the dislocated laths of martensite and the austenite films will vary with the alloy composition and the processing conditions and are not critical to this invention. In most cases, however, the retained austenite films will constitute from about 0.5% to about 15% by volume of the microstructure, preferably from about 3% to about 10%, and most preferably a maximum of about 5%. FIG. 2 is a sketch of the dislocated lath structure of the alloy, with substantially parallel laths 21 consisting of grains of martensite-phase crystals, the laths separated by thin films 22 of retained austenite phase. Notable in this structure is the absence of carbides and of precipitates in general (including nitrides and carbonitrides), which appear in the prior art structures as additional needle-like structures of a considerably smaller size scale than the two phases shown and dispersed throughout the dislocated martensite laths. The absence of these precipitates contributes significantly to the corrosion resistance of the alloy. The desired microstructure is also obtained by casting such steels, and by cooling at rates fast enough to achieve the microstructure depicted in FIG. 2, as stated above.

Figure 3:
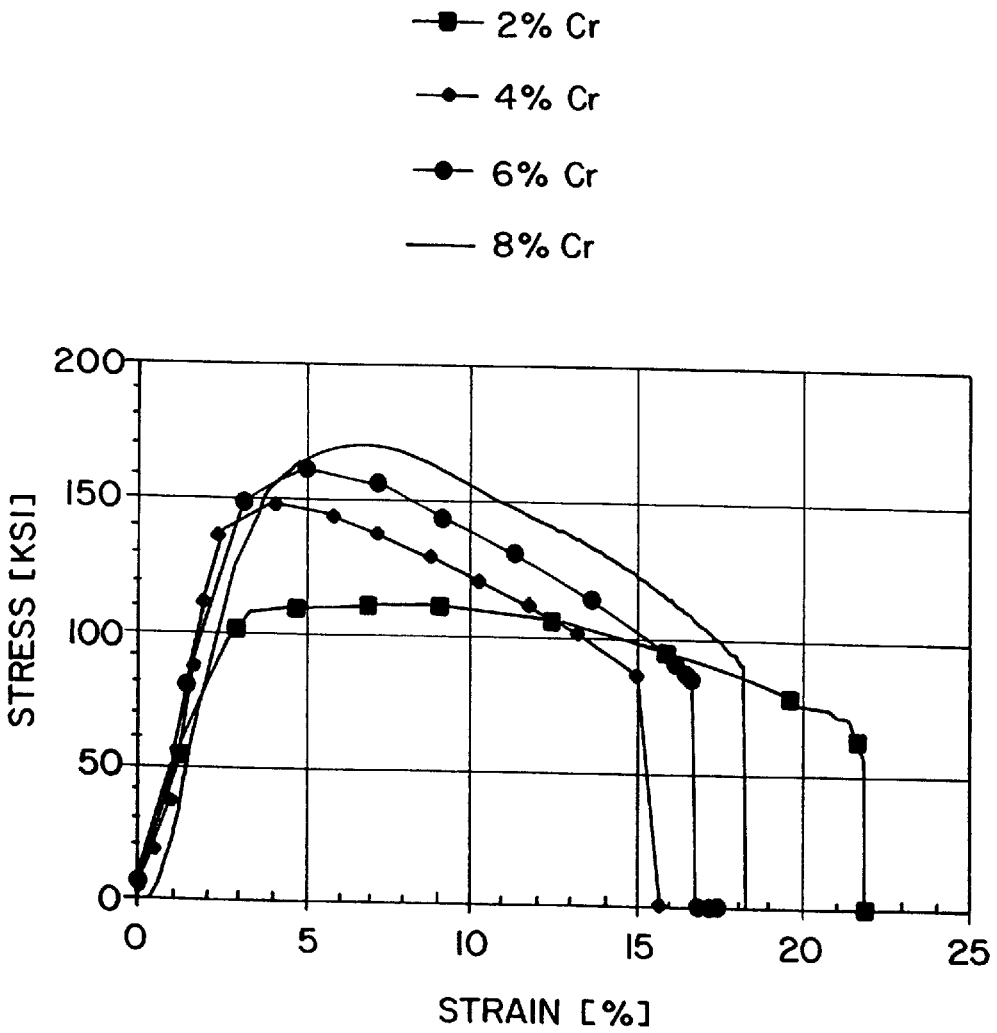
FIG. 3 is a plot of stress vs. strain for four alloys in accordance with this invention.

FIG. 3 is a plot of stress vs. strain for the microstructures of four alloys within the scope of the present invention, all four of which are of the dislocated lath arrangement and free of autotempered products. Each alloy has 0.05% carbon, with varying amounts of chromium, the squares representing 2% chromium, the triangles 4%, the circles 6% and the smooth line 8%. The area under each stress-strain curve is a measure of the toughness of the steel, and it will be noted that each increase in the chromium content produces an increase in the area and hence the toughness, and yet all four chromium levels exhibit a curve with substantial area underneath and hence high toughness.

The steel alloys of this invention are particularly useful in products that require high tensile strengths and are manufactured by processes involving cold forming operations, since the microstructure of the alloys lends itself particularly well to cold forming. Examples of such products are sheet metal for automobiles and wire or rods such as for radially reinforced automobile tires.

The foregoing is offered primarily for purposes of illustration. Further modifications and variations of the various parameters of the alloy composition and the processing procedures and conditions may be made that still embody the basic and novel concepts of this invention. These will readily occur to those skilled in the art and are included within the scope of this invention.

What is claimed is:

1. A process for manufacturing a high-strength, corrosion-resistant, tough alloy carbon steel, comprising:

(a) forming an alloy composition consisting of iron and at least one alloying element comprising carbon in proportions selected to provide said alloy composition with a martensite transition range having a martensite start temperature $M_s$ of at least about 350° C., said proportions further selected to permit air-cooling of said alloy composition through said martensite transition range without forming carbides;

(b) heating said alloy composition to a temperature sufficiently high to cause austenitization thereof, under conditions causing said alloy composition to assume a homogeneous austenite phase with all alloying elements in solution; and (c) cooling said homogeneous austenite phase through said martensite transition range at a cooling rate sufficiently fast to avoid the occurrence of autotempering, to achieve a microstructure containing laths of martensite alternating with films of retained austenite and containing substantially no carbides.

2. A process in accordance with claim 1 in which said carbon constitutes from about 0.01% to about 0.35% by weight of said alloy composition.

3. A process in accordance with claim 1 in which said carbon constitutes from about 0.05% to about 0.20% by weight of said alloy composition.

4. A process in accordance with claim 1 in which said carbon constitutes from about 0.02% to about 0.15% by weight of said alloy composition.

5. A process in accordance with claim 1 in which said at least one alloying element further comprises chromium in an amount sufficient to impart corrosion resistance to said carbon steel.

6. A process in accordance with claim 5 in which said chromium constitutes from about 1% to about 13% by weight of said alloy composition.

7. A process in accordance with claim 5 in which said chromium constitutes from about 6% to about 12% by weight of said alloy composition.

8. A process in accordance with claim 5 in which said chromium constitutes from about 8% to about 10% of said alloy composition.

9. A process in accordance with claim 1 in which said at least one alloying element further comprises silicon in an amount sufficient to impart corrosion resistance to said carbon steel.

10. A process in accordance with claim 9 in which said silicon constitutes from a maximum of about 2.0% by weight of said alloy composition.

11. A process in accordance with claim 9 in which said silicon constitutes from about 0.5% to about 2.0% by weight of said alloy composition.

12. A process in accordance with claim 1 in which said at least one alloying element further comprises nitrogen, and said cooling rate of step (c) is sufficiently fast to achieve a microstructure containing laths of martensite alternating with films of retained austenite and containing substantially no carbides, nitrides, or carbonitrides.

13. A process in accordance with claim 1 in which step (b) is performed at a temperature within the range of from about 900° C. to about 1150° C.

14. A process in accordance with claim 1 in which step (b) is performed at a temperature of a maximum of about 1150° C.

15. A process in accordance with claim 1 in which said films of retained austenite constitute from about 0.5% to about 15% of said microstructure of step (c).

16. A process in accordance with claim 1 in which said films of retained austenite constitute from about 3% to about 10% of said microstructure of step (c).

17. A process in accordance with claim 1 in which said films of retained austenite constitute a maximum of about 5% of said microstructure of step (c).

18. A process in accordance with claim 1 in which said carbon constitutes from about 0.05% to about 0.1% by weight of said alloy composition and said at least one alloying element further comprises (i) a member selected from the group consisting of silicon and chromium at a concentration of at least about 2% by weight and (ii) manganese at a concentration of at least about 0.5% by weight, and step (c) is performed by quenching in water.

19. A process in accordance with claim 1 in which said carbon constitutes from about 0.05% to about 0.1% by weight of said alloy composition and said at least one alloying element further comprises (i) a member selected from the group consisting of silicon and chromium at a concentration of about 2% by weight and (ii) manganese at a concentration of about 0.5% by weight, and step (c) is performed by quenching in water.

20. A process in accordance with claim 1 in which said carbon constitutes from about 0.03% to about 0.05% by weight of said alloy composition and said at least one alloying element further comprises (i) chromium at a concentration of from about 8% to about 12% by weight and (ii) manganese at a concentration of from about 0.2% to about 0.5% by weight, and step (c) is performed by air cooling.

21. A product manufactured by the process of claim 1.

22. A product manufactured by the process of claim 1 and comprising from about 0.05% to about 0.2% by weight carbon and from about 6% to about 12% by weight chromium.

23. A product manufactured by the process of claim 1 and comprising from about 0.05% to about 0.2% by weight carbon and up to about 2% by weight silicon.

24. A product manufactured by the process of claim 1 in which step (b) is performed at a maximum temperature of about 1150° C. and said films of retained austenite constitute a maximum of about 5% of said microstructure of step (c).

25. A product manufactured by the process of claim 18.

26. A product manufactured by the process of claim 19.

27. A product manufactured by the process of claim 20.

* * * * *